US010864513B2

(12) United States Patent
Williams, II et al.

(10) Patent No.: US 10,864,513 B2
(45) Date of Patent: Dec. 15, 2020

(54) CUSTOMIZABLE MOUNTING INTERFACE FOR A SEALED TRANSFER PORT

(71) Applicant: Delaware Capital Formation, Inc., Wilmington, DE (US)

(72) Inventors: Steven Bruce Williams, II, White Bear Lake, MN (US); Isaac M. Giesen, Red Wing, MN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 412 days.

(21) Appl. No.: 15/554,248

(22) PCT Filed: Feb. 29, 2016

(86) PCT No.: PCT/US2016/020100

§ 371 (c)(1),
(2) Date: Aug. 29, 2017

(87) PCT Pub. No.: WO2016/140920

PCT Pub. Date: Sep. 9, 2016

(65) Prior Publication Data

US 2018/0078930 A1 Mar. 22, 2018

Related U.S. Application Data

(60) Provisional application No. 62/211,173, filed on Aug. 28, 2015, provisional application No. 62/127,070, filed on Mar. 2, 2015.

(51) Int. Cl.
*B01L 1/02* (2006.01)

(52) U.S. Cl.
CPC ..... *B01L 1/02* (2013.01); *B01L 2200/023* (2013.01); *B01L 2200/141* (2013.01); *B01L 2300/043* (2013.01)

(58) Field of Classification Search
CPC ..... B01L 11/02; B01L 2200/023; B01L 2203/02; B01L 2203/141; B01L 2300/043; B01L 2300/04; B01L 2300/042
(Continued)

(56) References Cited

U.S. PATENT DOCUMENTS 4,010,588 A * 3/1977 Eisert ..... B25J 21/02 52/204.593
4,201,310 A 5/1980 Glachet et al.
(Continued)

FOREIGN PATENT DOCUMENTS

WO 0002804 1/2000
WO 2010054031 5/2014
(Continued)

OTHER PUBLICATIONS

"Ad System; Glove and Accessory Change System," La Calhene Information Sheet retrieved from www.lacalhene.com at least as early as Mar. 4, 2010 (2 pages).
(Continued)

*Primary Examiner* — Nathan Cumar
(74) *Attorney, Agent, or Firm* — Pauly, DeVries Smith & Deffner LLC

(57) ABSTRACT

A transfer port system is described herein having a port ring configured for placement in a barrier wall, where the port ring defines a port opening and an interface insert receptacle. The interface insert receptacle is configured to (1) interchangeably receive and (2) releasably fasten to each of a first interface insert and a second interface insert. The first interface insert defines a first set of mating features and the second interface insert defines a second set of mating features that are configured to form a seal with different mounting assemblies than the first mating features. The first
(Continued)

set of mating features has a first geometry that is different than a second geometry of the second set of mating features.

17 Claims, 15 Drawing Sheets

(58) Field of Classification Search
USPC ..... 292/256
See application file for complete search history.

(56) References Cited

U.S. PATENT DOCUMENTS

| | | | | |
|---|---|---|---|---|
| 5,090,782 | A * | 2/1992 | Glachet | G21F 7/053 312/1 |
| 5,447,699 | A | 9/1995 | Papciak et al. | |
| 5,735,609 | A | 4/1998 | Norton et al. | |
| 5,853,207 | A | 12/1998 | Prioult et al. | |
| 6,089,761 | A * | 7/2000 | Sakurai | G03B 17/14 359/828 |
| 6,655,759 | B2 | 12/2003 | Sacca | |
| 6,749,808 | B1 | 6/2004 | Huynen et al. | |
| 6,779,567 | B1 | 8/2004 | Szatmary et al. | |
| 6,835,362 | B1 | 12/2004 | Eriksson et al. | |
| 6,849,233 | B2 | 2/2005 | Bushnell et al. | |
| 6,958,234 | B2 | 10/2005 | Aicher et al. | |
| 6,969,497 | B2 | 11/2005 | Sacca et al. | |
| 7,191,670 | B2 | 3/2007 | Aicher et al. | |
| 7,282,176 | B2 | 10/2007 | Glachet et al. | |
| 7,600,726 | B2 | 10/2009 | Mumm et al. | |
| 7,678,096 | B2 | 3/2010 | Biddel et al. | |
| 7,780,248 | B2 | 8/2010 | Granadino et al. | |
| 7,810,528 | B2 | 10/2010 | Netzhammer | |
| 8,220,675 | B2 | 7/2012 | Rohard et al. | |
| 8,298,054 | B2 | 10/2012 | Hodge et al. | |
| 8,746,500 | B2 | 6/2014 | Chevalier et al. | |
| 8,790,588 | B2 | 7/2014 | Johansson | |
| 8,887,365 | B2 | 11/2014 | Rael et al. | |
| 8,950,624 | B2 | 2/2015 | Sacca | |
| 2008/0217366 | A1 * | 9/2008 | Rohard | G21F 7/053 223/111 |
| 2009/0050213 | A1 * | 2/2009 | Biddell | A61M 39/1011 137/15.01 |
| 2010/0301060 | A1 * | 12/2010 | Bernard | C12M 23/48 220/694 |
| 2011/0209410 | A1 * | 9/2011 | Norton | B01L 1/02 49/503 |
| 2012/0015394 | A1 | 1/2012 | Pflanz et al. | |
| 2012/0037633 | A1 | 2/2012 | Bernard et al. | |
| 2012/0038151 | A1 | 2/2012 | Bernard et al. | |
| 2012/0219388 | A1 | 8/2012 | Armau et al. | |
| 2012/0267367 | A1 | 10/2012 | Armau et al. | |
| 2012/0292311 | A1 | 11/2012 | Armau et al. | |
| 2013/0068316 | A1 | 3/2013 | Gueneron et al. | |
| 2014/0150924 | A1 * | 6/2014 | Nodin | B01L 1/02 141/1 |
| 2014/0150926 | A1 | 6/2014 | Nodin et al. | |

FOREIGN PATENT DOCUMENTS

| | | |
|---|---|---|
| WO | 2014172665 | 10/2014 |
| WO | 2016140920 | 9/2016 |

OTHER PUBLICATIONS

"Central Research Laboratories Sealed Pass-Through Enclosure System," Available at http://www.centres.com/nuclear/encl/encl.htm retrieved on Apr. 3, 2008 (1 page).

"International Preliminary Report on Patentability," for PCT Application No. PCT/US2016/020100 dated Sep. 14, 2017 (9 pages).

"International Search Report and Written Opinion," for PCT Application No. PCT/US2016/020100 dated Jun. 22, 2016 (12 pages).

Rael, G. David et al., "Retrofit of an Engineered Gloveport to a Los Alamos National Laboratory's Plutonium Facility Glovebox," WM2008 Conference Feb. 24-28, 2008, Abstract #8026, Los Alamos National Laboratory, Los Alamos, NM 87545 (9 pages).

"Response to Communication Pursuant to Rules 161(1) and 162 EPC," for European Patent Application No. 16719560.1 filed with the EPO Apr. 16, 2018 (7 pages).

* cited by examiner

CUSTOMIZABLE MOUNTING INTERFACE FOR A SEALED TRANSFER PORT

This application is being filed as a PCT International Patent application on Feb. 29, 2016 in the name of Delaware Capital Formation, Inc., a U.S. national corporation, applicant for the designation of all countries and Steven Bruce Williams, II, a U.S. Citizen, and Isaac M. Giesen, a U.S. Citizen, inventors for the designation of all countries, and claims priority to U.S. Provisional Patent Application No. 62/127,070, filed Mar. 2, 2015, and U.S. Provisional Patent Application No. 62/211,173, filed Aug. 28, 2015, the contents of which are herein incorporated by reference in its entireties.

FIELD

The currently disclosed technology generally relates to a sealed transfer port. More particularly the currently-disclosed technology relates to a sealed port with a customizable mounting interface and methods.

BACKGROUND

Transfer ports are used in a variety of industries to transfer materials from the ambient environment to an isolated environment without contamination of one or both of the environments. In the pharmaceutical industry, for example, it is common to transfer an uncontaminated biological substance located in an ambient environment to an uncontaminated environment such as a clean room using a transfer port. An example of a transfer port has an alpha assembly and a beta assembly.

The transfer port is generally associated with the isolated environment. The alpha assembly spans an opening in a barrier wall between the environments and one end of the alpha assembly extends into the ambient environment. The beta assembly is generally associated with the ambient environment and can be configured in a variety of ways, but generally defines a mounting structure that is configured to be received by a mounting interface defined by the transfer port in the wall that leads to the isolated environment. In one example configuration, the beta assembly is a sealed container containing a substance to-be-transferred. In another example, the beta assembly is a conduit for a liquid.

The beta assembly and the mounting interface of the transfer port form a seal to maintain isolation of the separated environments. Corresponding bayonet-type mounting surfaces on the transfer port, the container, and a container cover interact such that when the container is mounted to the port, the container cover mounts to the port door, and the container cover dismounts from the container. When the port door is opened, the container is opened as well, exposing the contents of the container (or the conduit) to the isolated environment.

Transfer ports are generally semi-permanent fixtures upon installation in an isolation wall. As such, the particular beta assemblies that can be mounted to a transfer port are limited to those beta assemblies that will form a seal with the mounting interface of the transfer port.

BRIEF DESCRIPTION OF THE DRAWINGS

The currently-described technology may be more completely understood and appreciated in consideration of the following detailed description of various embodiments in connection with the accompanying drawings.

DETAILED DESCRIPTION

Figure 1:
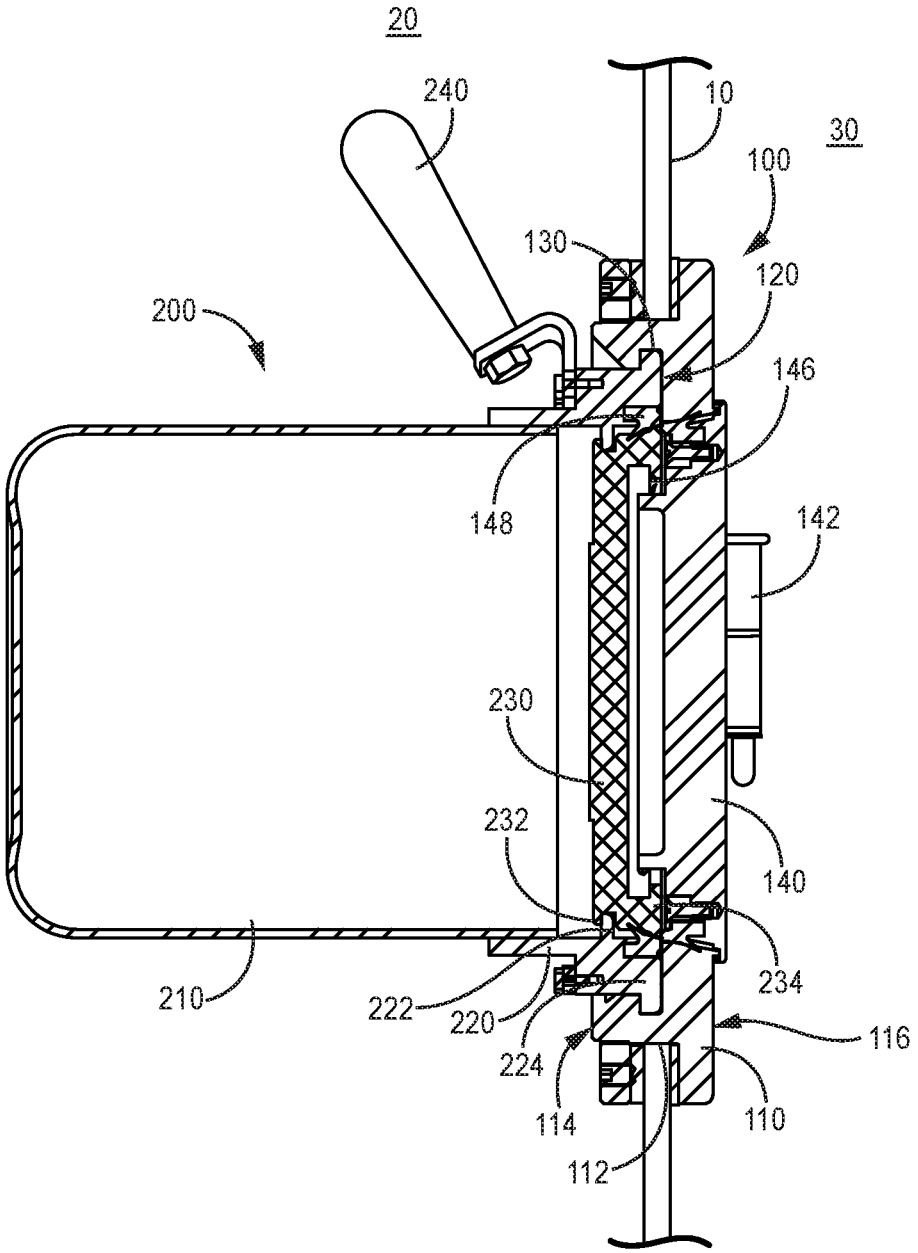
FIG. 1 depicts a simplified cross-sectional view of an example beta assembly mounted to an example transfer port.

FIG. 1 depicts a cross sectional view of an example transfer port having a beta assembly mounted thereto. The transfer port 100 extends from the first side 20 of the barrier wall 10 to the second side 30 of the barrier wall 10, where the first side 20 can be consistent with ambient conditions in at least one implementation of the technology described herein, and the second side 30 of the barrier wall 10 can be consistent with conditions that are relatively cleaner or dirtier than the ambient conditions. The barrier wall 10 and the transfer port 100 generally prevent contamination between the first side 20 and second side 30.

The phrases "first side" 20 and "second side" 30 will be used herein to refer to the two different sides of the barrier wall 10 where the second side 30 can be the isolated side of the wall in a variety of embodiments that can be a relatively "clean" or "dirty" side, and the first side 20 is the opposite side of the wall, which in some embodiments is associated with ambient conditions. The second side 30 of the wall can generally be contained on all sides by one or more barrier walls. It will be recognized by those of skill in the art that adjectives such as "dirty" or "clean" are non-limiting to the technology described herein. Indeed, the isolated environment, in a variety of instances, can be a contaminated or dirty environment and the non-isolated environment can be the relatively clean environment.

With regard to FIG. 1, a transfer port 100 has a cell flange 110 and a port door 140. The cell flange 110 has a first side 114 and a second side 116. The cell flange 110 is configured for placement in the barrier wall 10 and the first side 114 and second side 116 can correspond with the first side 20 and second side 30 of the barrier wall 10 (see FIG. 1), respectively. The cell flange 110 defines an extension portion 112 that is configured to extend through a port opening defined in the barrier wall 10 in fixed leak-proof sealed engagement with the periphery of the port opening. As such, the cell flange 110 mutually defines the port opening which extends from the first side 114 of the cell flange 110 to the second side 116 of the cell flange 110 through the barrier wall 10. The port door 140 is pivotably coupled to the second side 116 of the cell flange 110, which is the second side 30 of the barrier wall 10, with a door hinge 142. The port door 140 is generally configured to selectively and sealably obstruct the port opening. In FIG. 1 the port door 140 is shown in a closed position in leak-proof sealed engagement with the inside perimeter of the cell flange 110, and is pivotable to an open position about the door hinge 142. A door seal 148 is disposed between the port door 140 and the port ring 160.

As a broad overview, to transfer items between the second side 30 of the barrier wall 10 and the first side 20 of the barrier wall 10 without exposing the transfer items to the conditions on the first side 20 of the barrier wall 10 requires that a container or other type of sealed mounting assembly 200 containing the transfer items be sealably mounted to the transfer port 100 such that when the mounting assembly 200 is opened, the contents are only exposed to the second side 30 of the barrier wall 10 through the transfer port 100. This can be accomplished by sealably mounting the container 210 of the mounting assembly 200 around the transfer port 100 (such as to the cell flange 110) and, at the same time, sealably mounting the container cover 230 (also visible in FIG. 9) to the port door 140. As such, the outside surface of the container cover 230 that was previously in contact with conditions on the first side 20 is not exposed to the second side 30 of the barrier wall 10, which could result in contamination. The container cover 230 is released from a container portion 210 as the container cover 230 is mounted to the port door 140. When the port door 140 is then opened, the inside of the container portion 210 communicates with the port opening such that the contents of the container portion 210 can be removed in the second side 30.

Figure 9:
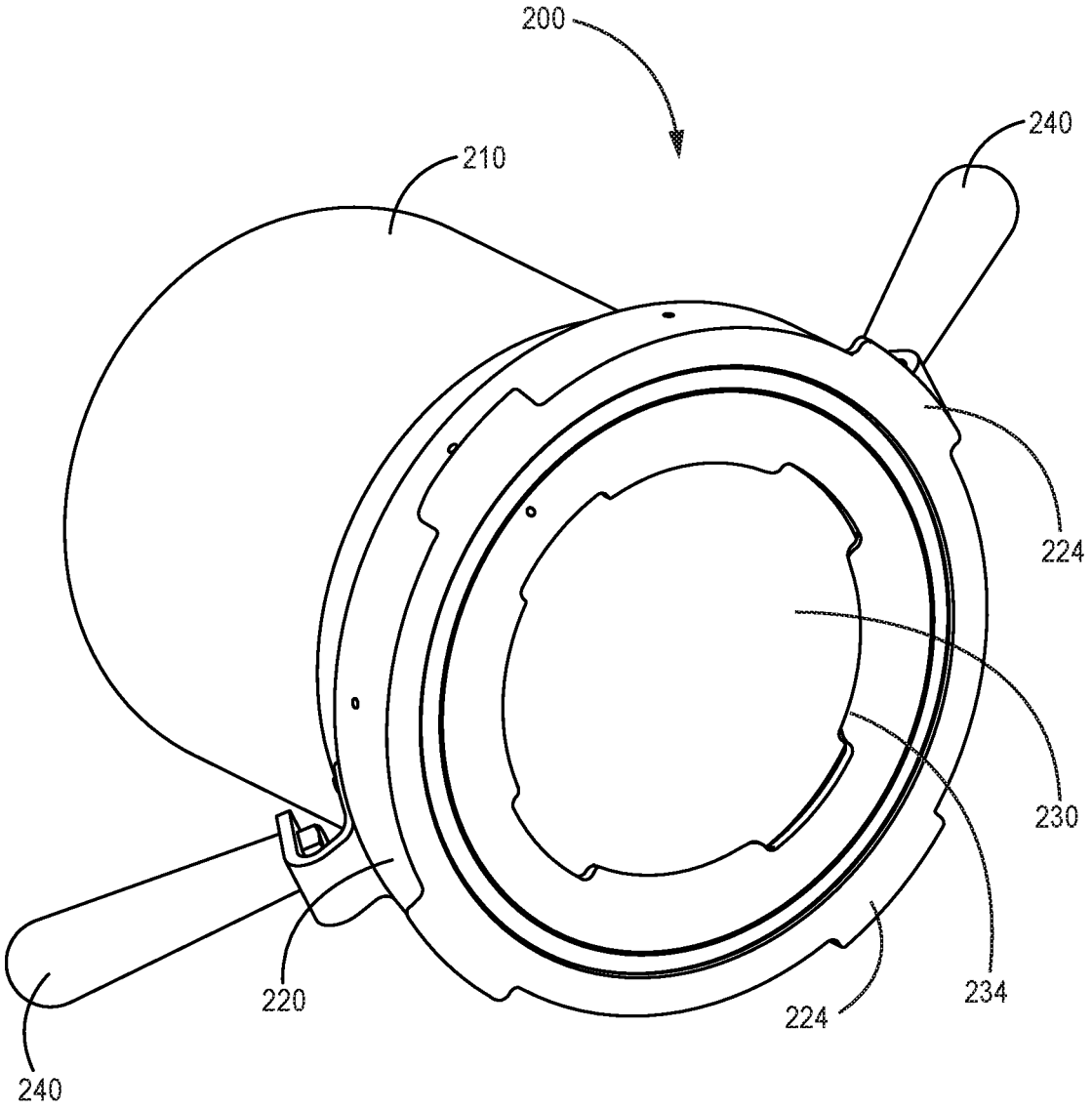
FIG. 9 depicts a perspective view of an example mounting assembly consistent with that depicted in FIG. 1.

The container portion 210 and container cover 230 can generally be referred to as a mounting assembly 200. FIG. 9 depicts an example mounting assembly 200 that is similar to that depicted in FIG. 1, shown uncoupled from a transfer port for purposes of this discussion. The mounting assembly 200 has a container portion 210, a flanged ring 220 configured to mount to a mounting interface of a transfer port 100, a removable container cover 230 and container handles 240 with which a user manually mounts the mounting assembly 200 to the transfer port 100 (See FIG. 1).

The flanged ring 220 is mountable to the cell flange 110 by virtue of bayonet connectors 224 that are configured to mate with bayonet receptacles 130 partially defined along a mounting interface 120 of the cell flange 110. The mounting interface 120 is generally the structure that the flanged ring 220 is rotated against when mounting the mounting assembly 200, and the bayonet receptacles 130 are generally the locations along the mounting interface 120 that receive corresponding bayonets when the mounting assembly 200 is in a mounted position. The flanged ring 220 is generally configured to form a leak-proof seal when mounted to the mounting interface 120 of the cell flange 110. In some embodiments the flanged ring 220 and the container portion 210 can be a cohesive unit, although in the current embodiment they are depicted as separate components.

The opening to the interior volume of the container portion 210, which is through a passage defined by the flanged ring 220, is sealably covered by a second mountable component, which is the container cover 230. The container cover 230 is mounted in sealed leak-proof engagement with a cover mounting surface 222 of the flanged ring 220 via cover bayonet connectors 232 where the cover mounting surface 222 of the flanged ring 220 is defined at least by an inner perimeter of the flanged ring 220. The container cover 230 also has a set of door bayonet connectors 234 on the outside of the container cover 230 that are configured to mount to corresponding door bayonet receptacles 146 defined on the surface of the first side 20 of the port door 140. As such, when the flanged ring 220 of the mounting assembly 200 is manually rotated by a user to mount the mounting assembly 200 to the mounting interface 120 on the cell flange 110 in sealed leak-proof engagement, the container cover 230 is also mounted to be in sealed leak-proof engagement with the first side 20 of the port door 140 and simultaneously released from the flanged ring 220.

Although shown as a container portion 210 in FIGS. 1 and 9, the mounting assembly 200 may take a variety of forms, depending upon particular transfer needs. For example, rubber septums for vials for containing injectable medications are commonly sterilized in bulk in a porous flexible bag, made of a material such as Tyvek® material made by DuPont (headquartered in Wilmington, Del., USA). The system may be used to sealably interconnect two similar isolation chambers having the same interior environment while protecting them from the surrounding dirty environment. Rubber gloves may likewise be introduced into an isolation chamber to permit manual operations to be performed while maintaining the integrity of the environment of the isolation chamber.

Referring again back to FIG. 1, the mounting assembly 200 defines a mating structure 224 that is configured to be received by a mounting interface 120 defined by one or more surfaces on the first side 20 of the cell flange 110. In a variety of embodiments, a system user can use the container handle 240 to bring the mounting assembly 200 in contact with the mounting interface 120. In some embodiments, the mating structure 224 is a series of one or more bayonet connectors 224 defined on the flanged ring 220 of the mounting assembly 200. The one or more bayonet connectors 224 are received by one or more corresponding bayonet receptacles 130 defined at least by the mounting interface 120 of the cell flange 110 when the mounting assembly 200 is rotated relative to the cell flange 110. Correspondingly, the container cover 230 defines one or more bayonet connectors 234 that are configured to be received by corresponding door bayonet receptacles 146 defined by the port door 140. As the mounting assembly 200 is mounted, the container cover 230 is dismounted from the flanged ring 220 of the mounting assembly 200 and mounted to the port door 140.

After mounting the flanged ring 220 to the cell flange 110 and the container cover 230 to the port door 140, which releases the container cover 230 from the mounting assembly 200, the port door 140 can be opened and swung out of the way of the port opening through the cell flange 110, carrying the mounted container cover 230 with it. The port opening defined by the cell flange 110 and the flanged ring 220 is open such that the environment within the container portion 210 is accessible and exposed to the environment on the second side 30 of the barrier wall 10. The container portion 210 can then be emptied or loaded.

When the transfer is completed the port door 140 is closed. Upon closing of the port door 140 and during the process of manually disengaging the container portion 210 from the cell flange 110, the container cover 230 disengages the port door 140 and re-engages the flanged ring 220, such that the container cover 230 once again seals the container portion 210. Further successive transfers may be made simply by docking a succession of mountable assemblies containing material to be transferred until the operation being performed within the isolated environment 30 is completed. Although the system is described with reference to the transfer of material into an isolated environment, the same series of steps is carried out in transferring materials from within the isolated environment to the ambient environment.

Figure 2:
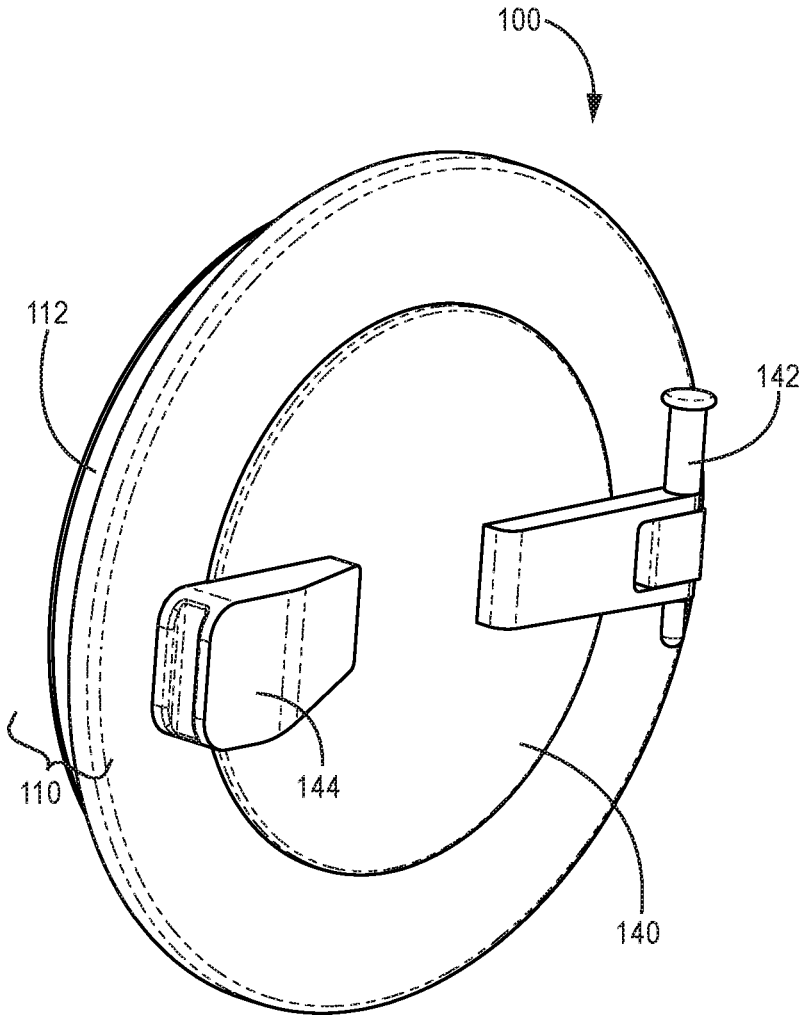
FIG. 2 depicts a perspective view one side of an example transfer port, consistent with the technology disclosed herein.

FIG. 2 depicts a perspective second-side view of the transfer port 100 of FIG. 1. In this view, the transfer port 100 has a port door 140 that sealably obstructs the port opening and is sealably closed against the cell flange 110. The cell flange 110 has an extension portion 112 that is configured to extend through a barrier wall 10 (FIG. 1) upon installation. A stationary handle 144 can be used by a system user to manually open and close the port door 140. In some embodiments the handle is not stationary, and is manually or otherwise actuated to engage and/or disengage the port door from the cell flange 110.

Figure 3:
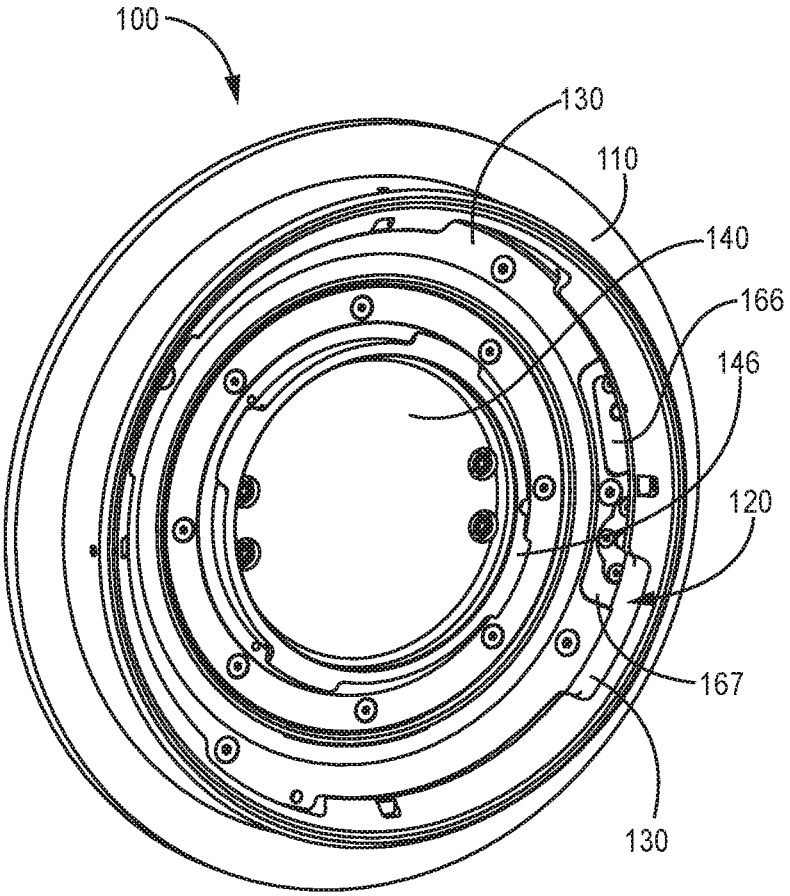
FIG. 3 depicts a perspective view of one opposite side of the transfer port depicted in FIG. 2.

FIG. 3 depicts a perspective first-side view of the transfer port 100 which is generally consistent with the embodiment depicted in FIGS. 1 and 2, with the understanding that FIG. 1 is a simplified view of the transfer port. Similar to FIG. 2, the port door 140 sealably obstructs the port opening against the cell flange 110. A mounting interface 120 of the cell flange 110 partially defines bayonet receptacles 130 that are configured to receive bayonets of a mounting assembly 200, such as described in FIG. 1. The port door 140 defines door bayonet receptacles 146 that are also configured to receive bayonets defined by a mounting assembly, such as a cover of a beta assembly.

Also visible in FIG. 3 are a first interlock device 166 and a second interlock device 167 that can be consistent with interlock devices described, for example, in Published Application No. WO2014/172665. One interlock assembly 167 can be a door interlock that is configured to engage a latch receptacle defined by the port door 140 and receive a mounting assembly on the first side of the cell flange 110. Such an interlock assembly can completely release the port door 140 upon receiving a mounting assembly. Another interlock assembly 166 can be a container interlock assembly is configured to obstruct translation of the mounting assembly (such as a container) relative to the cell flange 110 when the port door 140 is open.

Transfer ports consistent with the current technology, including the embodiment depicted in FIG. 3, are customizable to define a variety of differently-configured mounting interfaces, such that each mounting interface can be configured to sealably receive mounting assemblies having specific docking features. This customization is enabled because an interface insert, defining a first mating structure of a particular geometry, can be removed and replaced. As needed, a different, second interface insert can be used that has a mating structure with a different geometry than the first mating structure, which is configured to seal against a different type of mounting assembly, such as different canisters, bags or other structures having different docking features. The phrase "different docking features" is intended to mean that the features that are configured to mate with a mounting interface have different geometric shapes and/or measurements. Because the interface insert can be changed, the owner of the transfer port obtains the flexibility to use multiple types of canisters, bags or other mounting assemblies, without needing to change or replace the underlying transfer port.

Figure 4:
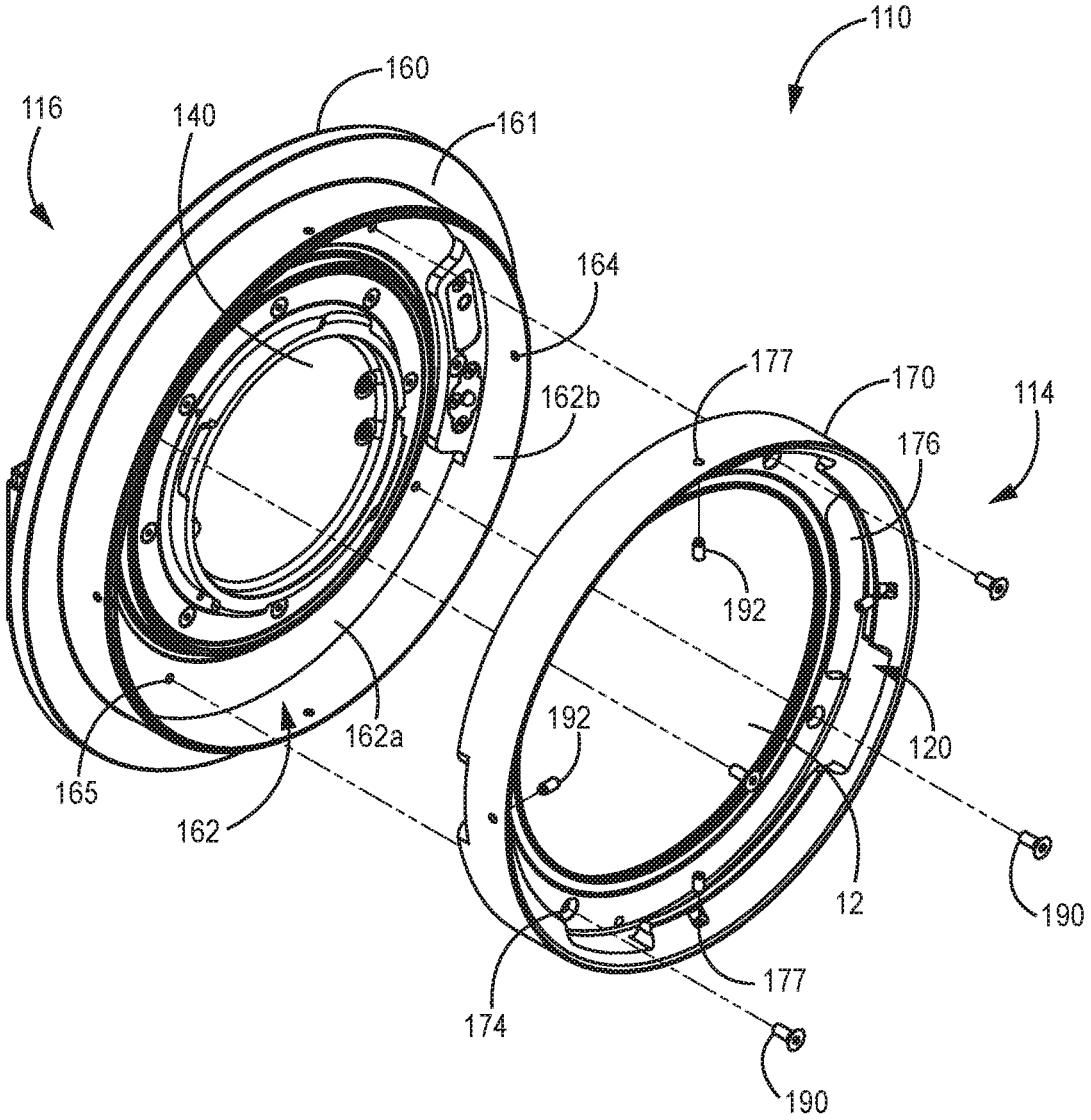
FIG. 4 depicts an exploded view of a transfer port consistent with the embodiment depicted in FIG. 3.
Figure 5:
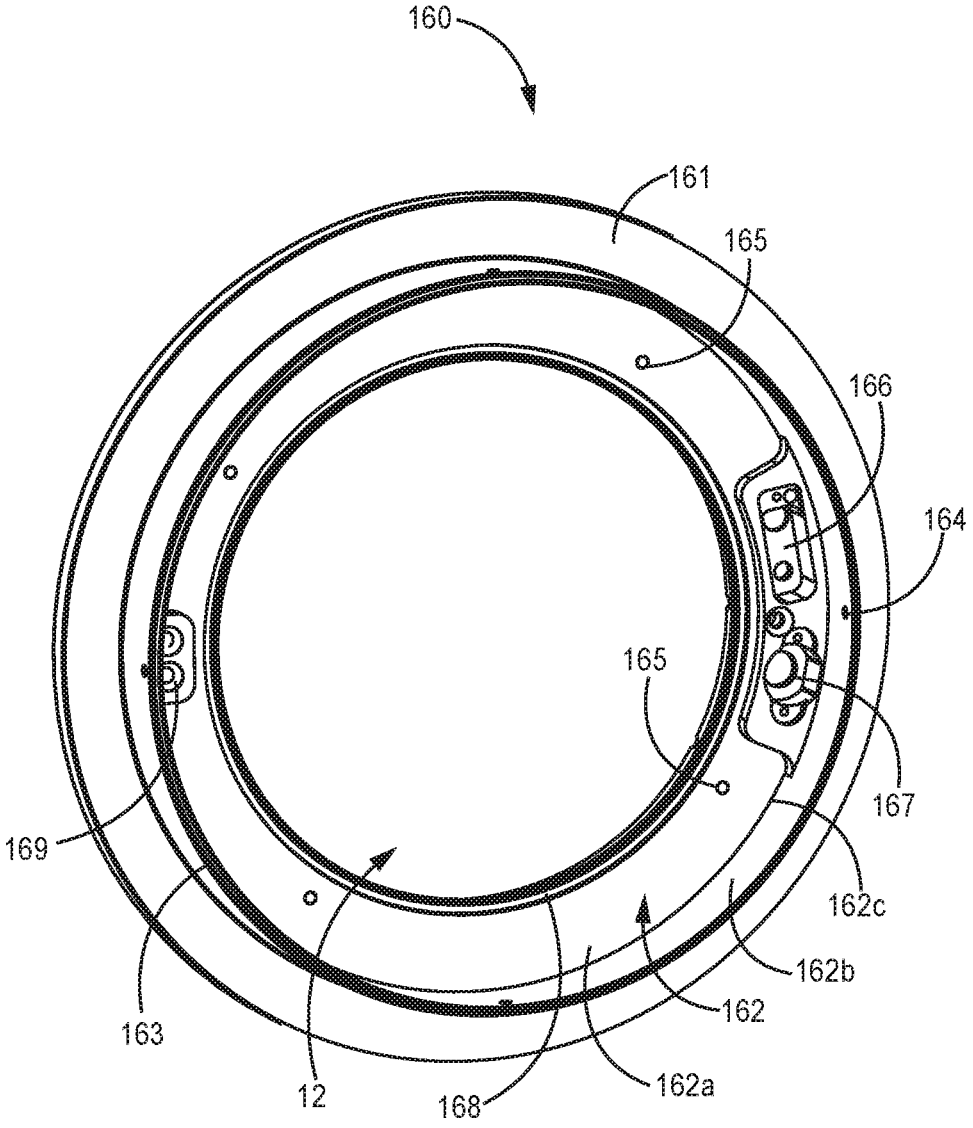
FIG. 5 depicts a perspective view of an example cell flange consistent with at least one implementation of the current technology.
Figure 6A:
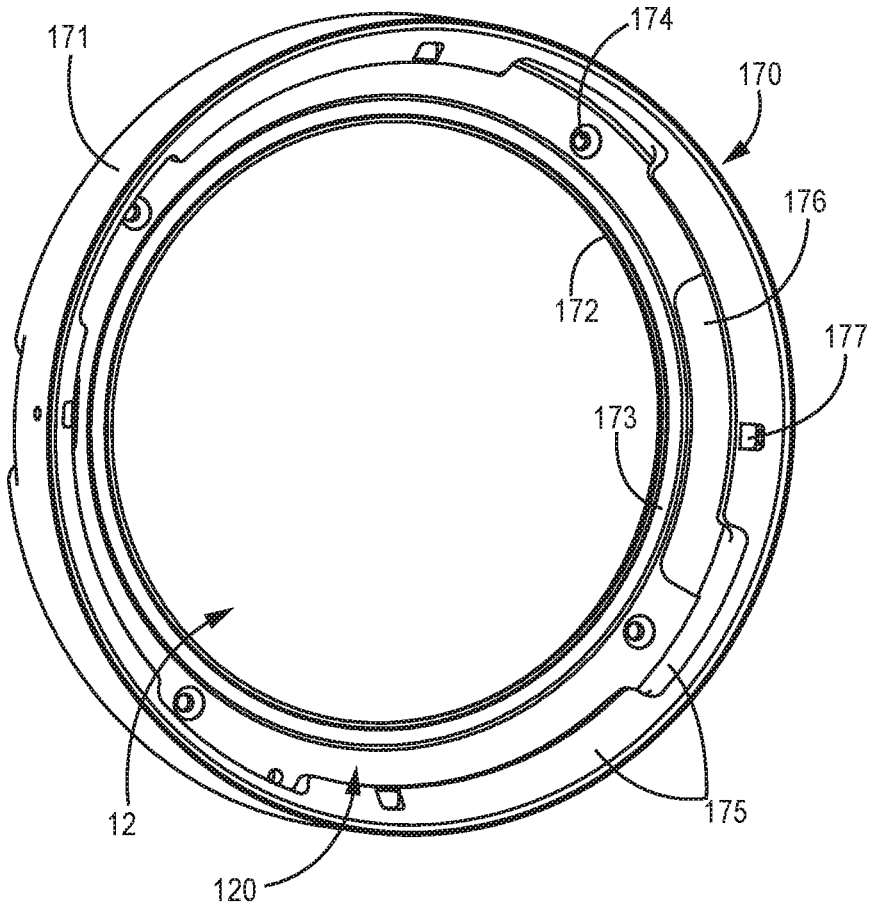
FIG. 6A depicts a perspective view of an example interface insert consistent with at least one implementation of the current technology.
Figure 6B:
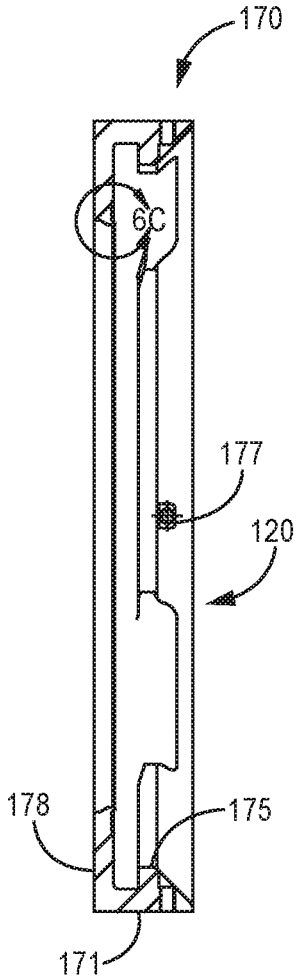
FIG. 6B depicts a cross-sectional view of the example interface insert of FIG. 6A.
Figure 6C:
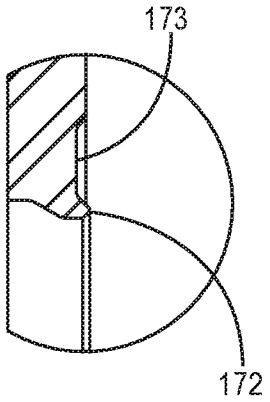
FIG. 6C depicts a detail view of FIG. 6B.
Figure 8:
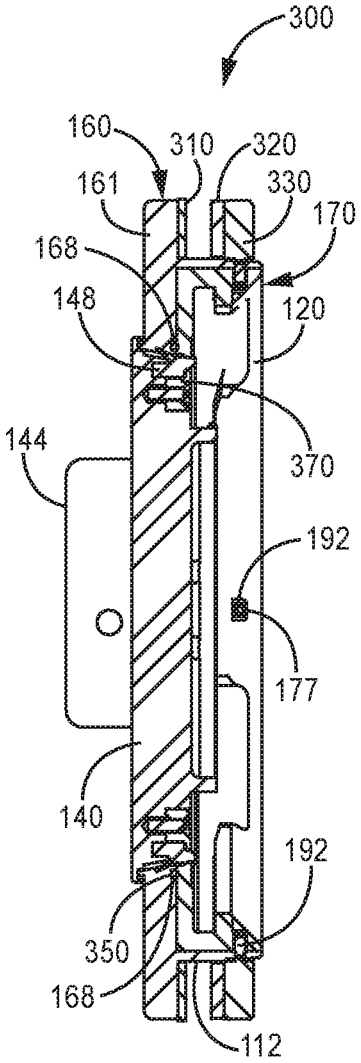
FIG. 8 depicts a cross-sectional view of a transfer port consistent with the embodiment of FIGS. 3-4.

For example, FIG. 4 depicts a perspective exploded view of the cell flange 110 depicted in FIG. 3. Two components mutually define the cell flange 110: a port ring 160 and an interface insert 170. FIG. 5 depicts a perspective first-side view of the port ring 160 alone. FIG. 6A depicts a perspective first-side view of the interface insert 170 alone, FIG. 6B depicts a cross-sectional view of the interface insert 170, and FIG. 6C depicts a detail view of the interface insert 170. FIG. 8 depicts a cross-sectional view of a transfer port assembly 300 where the interface insert 170 is coupled to the port ring 160.

Referring to FIGS. 4 and 5, the port ring 160 of the cell flange 110 is generally configured to be sealably placed in a barrier wall defining an opening. The port ring 160 defines a port opening 12 and an outer flange 161 extending radially outward from the port opening 12 and an extension portion 163. The outer flange 161 is defined towards the second side of the cell flange 110 and is configured to abut a barrier wall on a second side of the barrier wall (see FIG. 1). The extension portion 163 is configured to extend through the barrier wall. The port ring 160 is configured to be coupled to a port door (see FIG. 1) via a door coupling fastening mechanism 169, such as a hinge, that is configured to couple to the port door. One or more interlock devices 166, 167 extend from the second side 116 of the port ring 160 (and, therefore, the second side 116 of the cell flange 110) towards the first side 114 of the cell flange 110.

The port ring 160 is generally configured to sealably and reversibly receive a plurality of interface inserts, such as first example interface insert 170. More specifically, the port ring 160 defines a sealing surface 168 and an interface insert receptacle 162 on the first side 114 of the cell flange 110. The sealing surface 168 is generally configured to receive a gasketing material that is configured to form a seal with an interface insert 170, wherein the term "gasketing material" is defined to mean any material that can be used to form a seal between rigid components such as an o-ring, flat gasket, silicone potting compound, and the like. The sealing surface 168 is generally concentric to the port opening 12. In a variety of embodiments the sealing surface 168 is adjacent to the port opening 12, and in some embodiments the sealing surface 168 is abutting the port opening 12. The sealing surface 168 can be a ridge, an indentation, or a planar surface that is configured to contact the gasketing material. In some implementations it can be desirable to minimize the distance between the sealing surface 168 and the port opening 12.

The interface insert receptacle 162 is configured to receive the interface insert 170 and generally has at least a portion of an annular surface 162*a* and an inner cylindrical face 162*b* extending between the first side 114 of the cell flange 110 and the annular surface 162*a*. The annular surface 162*a* is generally concentric to the port opening 12 and/or concentric to the sealing surface 168, where "at least a portion of an annular surface" is intended to mean that there will generally be one or more discontinuities in the annular surface 162*a*. For example, in the current embodiment, fastener openings 165 also can define discontinuities in the annular surface 162*a* of the interface insert receptacle 162. As another example, the first interlock device 166 and the second interlock device 167 extend from the second side 116 of the cell flange 110 through the annular surface 162*a* of the interface insert receptacle 162, such that the interlock assemblies 166, 167 define a discontinuity of the annular surface 162*a* of the interface insert receptacle 162. In a variety of embodiments, one or more interlock assemblies 166, 167 protrudes from the annular surface 162*a* of the interface insert receptacle 162.

The annular surface 162*a* can have a variety of shapes. For example, in some embodiments the annular surface can be conical. Generally the annular surface 162*a* extends radially outward from the sealing surface 168 and defines an outer perimeter 162*c*. The annular surface 162*a* can generally be configured to abut a surface of the interface insert 170, which will be described in more detail, below.

The inner cylindrical face 162*b* of the interface insert receptacle 162 generally extends from the annular surface 162*a* of the interface insert receptacle 162. In some embodiments, the inner cylindrical face 162*b* extends from the outer perimeter 162*c* of the annular surface 162*a* towards the first side 114 of the cell flange 110. In some embodiments, the inner cylindrical face 162*b* is substantially perpendicular to the annular surface 162*a*. The inner cylindrical face 162*b* can have a variety of shapes, and in at least some embodiments, the inner cylindrical face 162*b* is conical. In such embodiments, the inner cylindrical face 162*b* can extend at an angle other than perpendicularly from the annular surface 162*a* of the interface insert receptacle 162.

The interface insert receptacle 162 of the port ring 160 is configured to sealably fasten to the interface insert 170. In a variety of embodiments, the port ring 160 itself is not configured to receive a mounting assembly. For example, the port ring 160 does not define bayonet connectors that are configured to receive a mounting assembly, rather, the port ring 160 is configured to receive an interface insert 170 that does define bayonet connectors 175 (see FIG. 6A, for example) that are configured to receive a mounting assembly. Referring particularly to FIGS. 4, 6A, and 6B, the interface insert 170 generally is an annular body having an outer cylindrical face 171. The second side 116 of the interface insert 170 has an end surface 178 defining a ring. The end surface 178 is generally configured to be received by the interface insert receptacle 162 to abut the annular surface 162*a* of the interface insert receptacle 162. In a variety of embodiments, the end surface 178 of the interface insert 170 defines at least one interlock opening 176 that is configured to accommodate the interlock assemblies 166, 167 that extend through the annular surface 162*a* of the interface insert receptacle 162.

As mentioned above, the interface insert 170 is configured to allow sealable mounting of one or more mounting assemblies. Specifically, the first side 114 of the interface insert 170 has a mounting interface 120 that defines a set of mating features that are configured to receive and form a seal with a particular mounting assembly configuration. The phrase "mating features" is used herein to mean the physical features of the mounting interface 120 that are configured to accommodate and/or form a seal with a particular mounting assembly, including the specific geometry of those physical features, where the term "geometry" refers to the sizes and shapes of the mating features. For example, with reference to FIGS. 6B and 6C, the mounting interface 120 of the interface insert 170 has mating features such as the bayonet connectors 175 that are configured to receive mating bayonet connectors of a particular mounting assembly configuration, the number of bayonet connectors 175 (such as bayonets or bayonet receptacles), the measurements of the bayonet connectors 175 such as the depth of the bayonet receptacle, the presence and measurements of a relief channel 173 that can be configured to accommodate the shape of the particular mounting assembly configuration, and the presence and measurements of a sealing ridge 172 that can be configured to form a seal with the particular mounting assembly configuration.

Referring now to FIGS. 4, 5 and 6A, each of the port ring 160 and the interface insert 170 mutually define a fastening structure that is configured to releasably fasten the interface insert 170 relative to the interface insert receptacle 162. In a variety of embodiments, the port ring 160 at least partially defines a fastening structure that is a first plurality of fastener openings 165 defined by the annular surface 162*a* of the interface insert receptacle 162 and a second plurality of fastener openings 164 defined by the inner cylindrical face 162*b* of the interface insert receptacle 162. The first plurality of fastener openings 165 extend substantially parallel to the length of the port opening 12 and the second plurality of fastener openings 164 extend substantially radially through the inner cylindrical face 162*b*. In some embodiments the first plurality of fastener openings 165 are insert screw openings and the second plurality of fastener openings 164 are set screw openings that are each configured to receive screws or other fastening mechanisms. The interface insert 170 defines first corresponding fastener openings 174 that are configured to substantially align with the first plurality of fastener openings 165 of the port ring 160. The interface insert 170 also defines second corresponding fastener openings 177 that are configured to substantially align with the second plurality of fastener openings 164 of the port ring 160.

It will be appreciated that a variety of types of fastening structures are contemplated with configurations different than those depicted in the current drawings. For example, in some embodiments the interface insert receptacle 162 and the interface insert 170 can reversibly fasten through the use of clamps. In some embodiments one of the interface insert receptacle 162 or the interface insert 170 can defines threads that are engaged by the other of the interface insert receptacle 162 or the interface insert 170. Combinations of fastening structures can be used, as well.

The port ring 160 is generally installed in a port wall similarly to methods known in the art. One method of installation has the following steps (refer to FIG. 8):

a. From the inside of the isolated environment, install the extension portion 112 of the port ring 160 through a port opening in the barrier wall (not shown), with a seal 310 disposed between the outer flange 161 of the port ring 160 and the barrier wall (not shown). The seal 310 can generally be a gasketing material, defined above.
b. From the opposite side of the barrier wall, slide on a backing ring 320 over the extension portion 112 of the port ring 160, and turn on a nut 330 to form a seal between the barrier wall and the extension portion 112.

The interface insert 170 is inserted into the interface insert receptacle 162 (see FIG. 4) defined by the port ring 160, which is installed in the barrier wall. The interface insert 170 is fastened to the port ring 160 which, in the current embodiment, is accomplished by inserting fasteners 190, 192 into the fastener openings 164, 165, 174, 177 mutually defined by each of the port ring 160 and the interface insert 170. As described above, the interface insert 170 and the port ring 160 can fasten through alternative or additional configurations, as well. A gasketing material 350 such as an o-ring is placed in contact with the sealing surface 168 abutting the port opening 12 and in contact with the end surface 178 of the interface insert 170 such that the port ring 160 and the interface insert 170 mutually define a seal when the interface insert 170 is fastened to the port ring 160. In some embodiments the gasketing material 350 is a component of either the port ring 160 or the interface insert 170, while in other embodiments the gasketing material 350 is a separate component distinct from the port ring 160 and the interface insert 170. When the interface insert 170 is installed in the port ring 160, a door seal 148 disposed between the port ring 160 and the port door 140 can also be disposed between the interface insert 170 and the port door 140.

The mounting interface 120 of the interface insert 170 defines a set of mating features that are configured to form one or more seals with particular mounting assembly configurations. In a variety of embodiments, once the interface insert 170 is fastened to the port ring 160 to form a cell flange 110, a mounting assembly 200 (see FIG. 1) is mounted to the mounting interface 120 defined by the interface insert 170. However, some alternate mounting assembly configurations would not form a seal with the mounting interface 120 of the interface insert 170. If circumstances dictate using such an alternate mounting assembly configuration, a first interface insert can be replaced by a second interface insert defining a second mounting interface that is configured to form a seal with the alternate mounting assembly configuration.

Figure 7A:
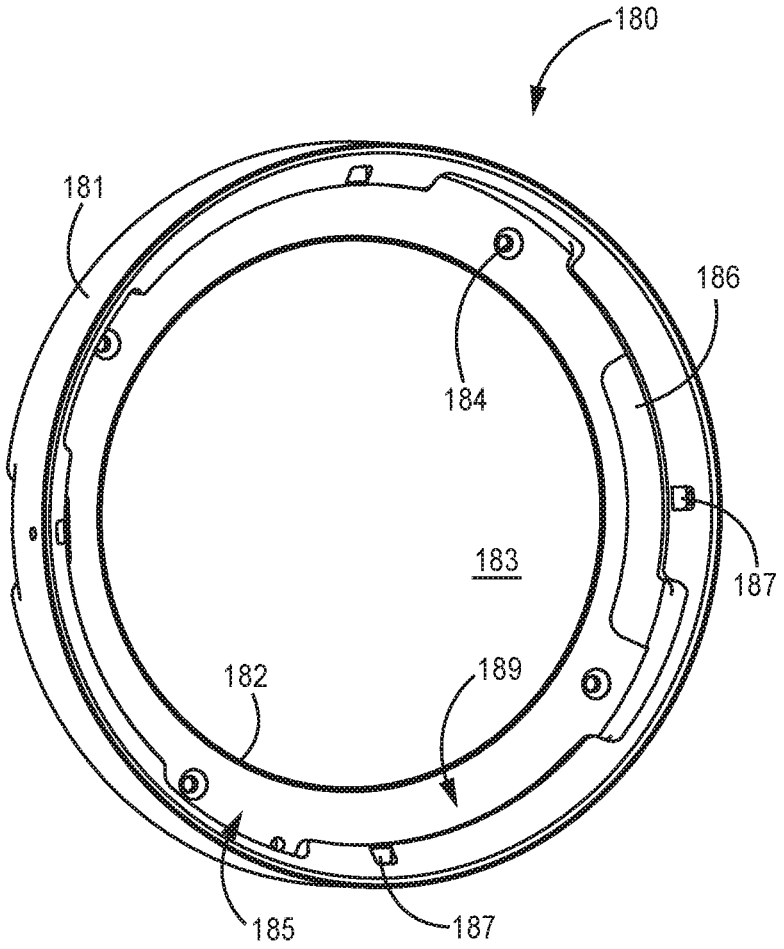
FIG. 7A depicts a perspective view of another example interface insert consistent with at least one implementation of the current technology.
Figure 7B:
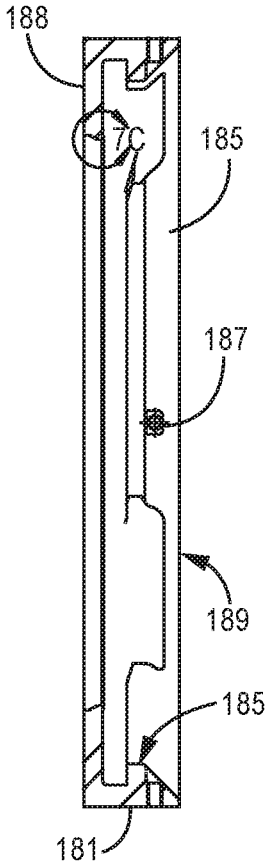
FIG. 7B depicts a cross-sectional view of the example interface insert of FIG. 7A.
Figure 7C:
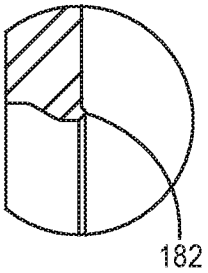
FIG. 7C depicts a detail view of FIG. 7B.

FIGS. 7A-7C depict an example second interface insert 180 consistent with the technology disclosed herein. The second interface insert 180 is configured to sealably fasten to the port ring 160 of FIG. 5. The second interface insert 180 is an annular body having an end surface 188 and an outer cylindrical face 181 that are configured to be received by the interface insert receptacle 162. The end surface 188 is generally ring-shaped, although there can be one or more discontinuities in the shape of the end surface 188. The annular body of the second interface insert 180 is configured to mutually define the port opening 183 of the cell flange 110 and configured to mutually define a seal with the port ring 160 concentric to the port opening 183. The second interface insert 180 at least partially defines a fastening structure that is configured to fasten to the interface insert receptacle 162, where the fastening structure is fastener openings 184, 187 that are configured to receive fasteners. The end surface 188 of the second interface insert 180 defines an interlock opening 186 that is configured to accommodate one or more interlock assemblies 166, 167 of the port ring 160.

The second interface insert 180 has a second mounting interface 189 defining a second set of mating features that are configured to form a seal with a second mounting assembly configuration, such as bayonet connectors 185 and a sealing ridge 182. The second set of mating features have a different geometry than the geometry of the set of mating features of the mounting interface 120 of the first interface insert 170 described herein. For example, the second interface insert 180 lacks a relief channel (compare to relief channel 173 in FIGS. 6A and 6C) that is a mating feature of the mounting interface 120 of the first interface insert 170. As another example, the dimensions of bayonet connectors 185 and/or the sealing ridge 182 of the second interface insert 180 can be different than corresponding components of the first interface insert 170.

Figure 11A:
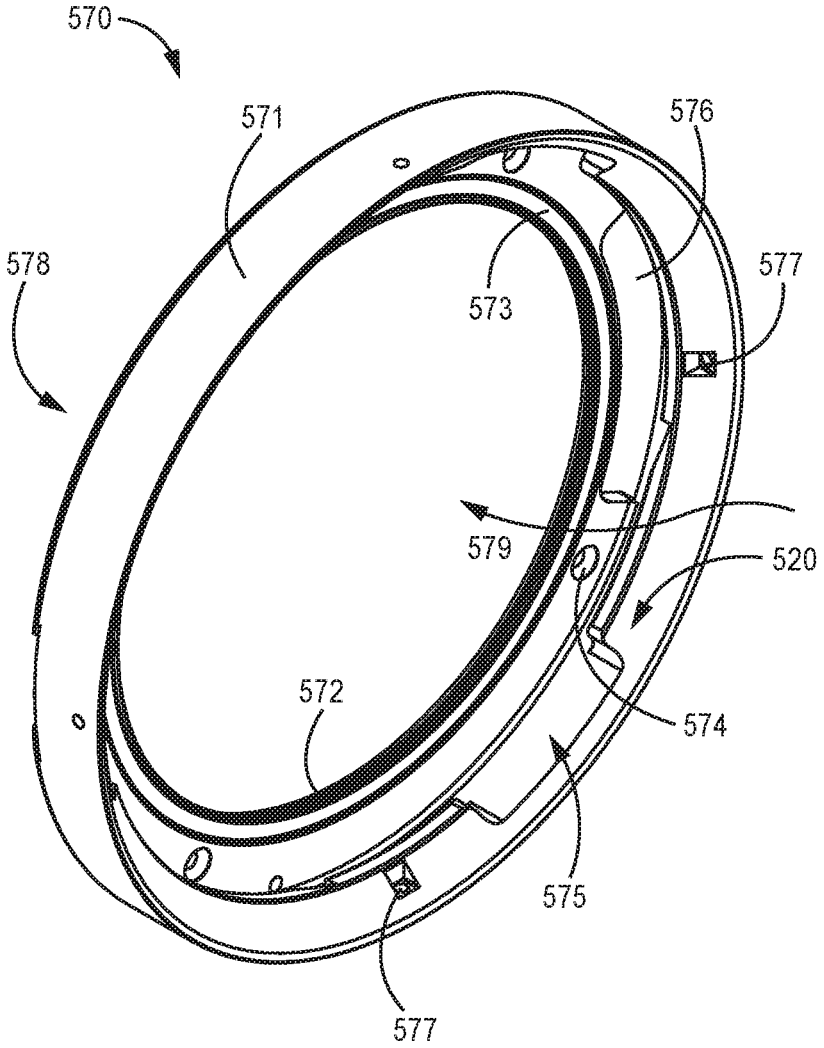
FIG. 11A depicts a perspective view of another example interface insert consistent with implementations of the current technology.
Figure 11B:
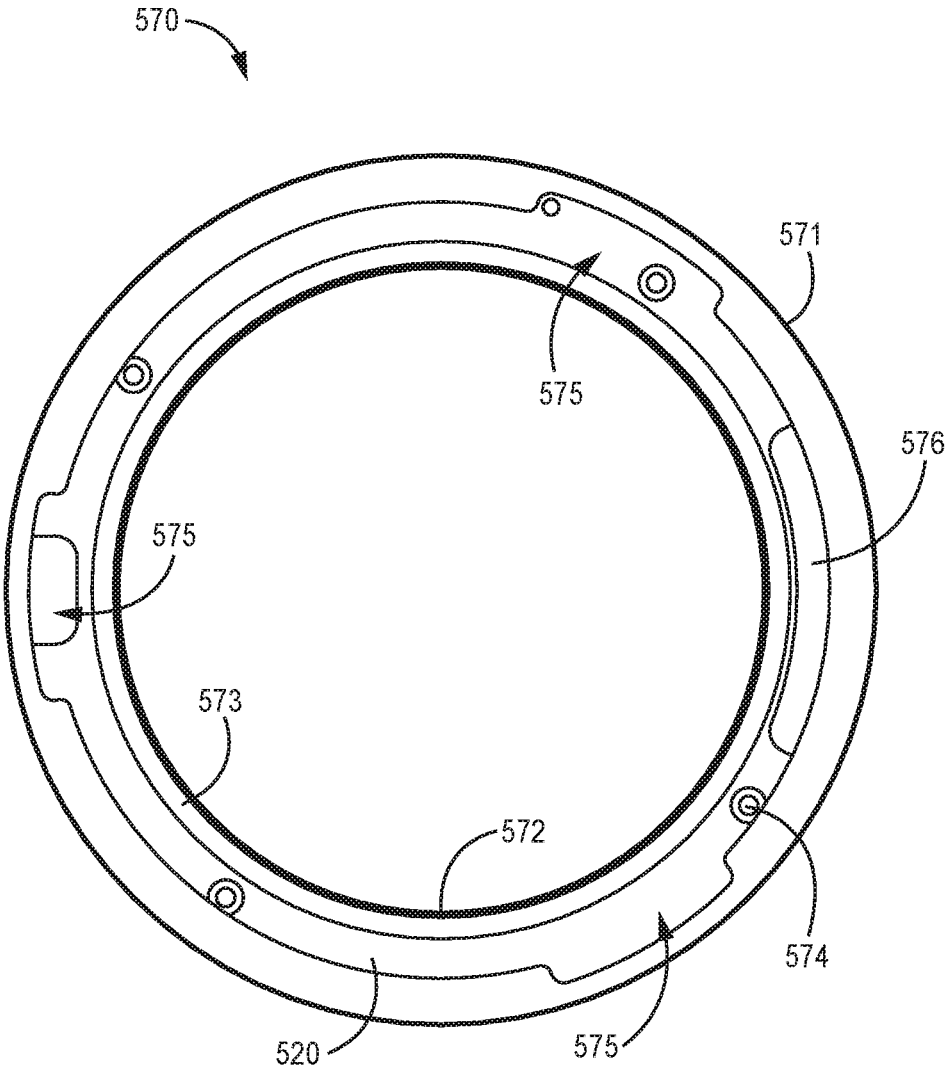
FIG. 11B depicts a front view of the example interface insert of FIG. 11A.

FIGS. 11A-11B depict an example third interface insert 570 consistent with the technology disclosed herein. The third interface insert 570 is also configured to sealably fasten to the port ring 160 of FIG. 5. The third interface insert 570 is an annular body having an end surface 578 and an outer cylindrical face 571 that are configured to be received by the interface insert receptacle 162. The end surface 578 is generally ring-shaped, although there can be one or more discontinuities in the shape of the end surface 578. The annular body of the third interface insert 570 is configured to mutually define a port opening 579 of the cell flange 110 and configured to mutually define a seal with the port ring 160 concentric to the port opening 579. The third interface insert 570 at least partially defines a fastening structure that is configured to fasten to the interface insert receptacle 162. The fastening structure can be fastener openings 574, 577 that are configured to receive fasteners. The end surface 578 of the third interface insert 570 defines an interlock opening 576 that is configured to accommodate one or more interlock assemblies 166, 167 of the port ring 160.

The third interface insert 570 has a third mounting interface 520 defining a third set of mating features that are configured to form a seal with a third mounting assembly configuration, such as bayonet connectors 575 and a sealing ridge 572. The third set of mating features have a different geometry than the geometry of the set of mating features of the mounting interface 120 of the first interface insert 170 and the geometry of the set of mating features of the mounting interface 189 of the second interface insert 180, described herein. For example, the third interface insert 570 has a relief channel 573 that can have different measurements than the relief channel 173 of the first example interface insert 170 (FIGS. 6A and 6C). As another example, the third interface insert 570 defines a different number of bayonet connectors 575 than the first example interface insert 170 and the second example interface insert 180. In particular, the third interface insert 570 defines three bayonet receptacles 575.

The first interface insert 170, the second interface insert 180, and the third interface insert 570 are generally configured to be interchangeable with respect to the port ring 160, to allow the transfer port to accommodate mating features of multiple mounting assembly constructions. As such, the interface insert receptacle 162 is configured to interchangeably receive and releasably fasten to each of the first interface insert 170, the second interface insert 180, and the third interface insert 570.

Generally, when a user wants to change the particular mounting assembly configuration that can be mounted to the transfer port, the interface insert may need to be changed, depending on the mounting features of the mounting assembly of the interface insert that is installed in the port ring. If the interface insert installed in the port ring has a mounting interface having a set of mating features that will not form a seal with the desired mounting assembly, then the installed interface insert can be replaced with a second interface insert with a mounting interface having a set of mating features that will form a seal with the desired mounting assembly.

Figure 12:
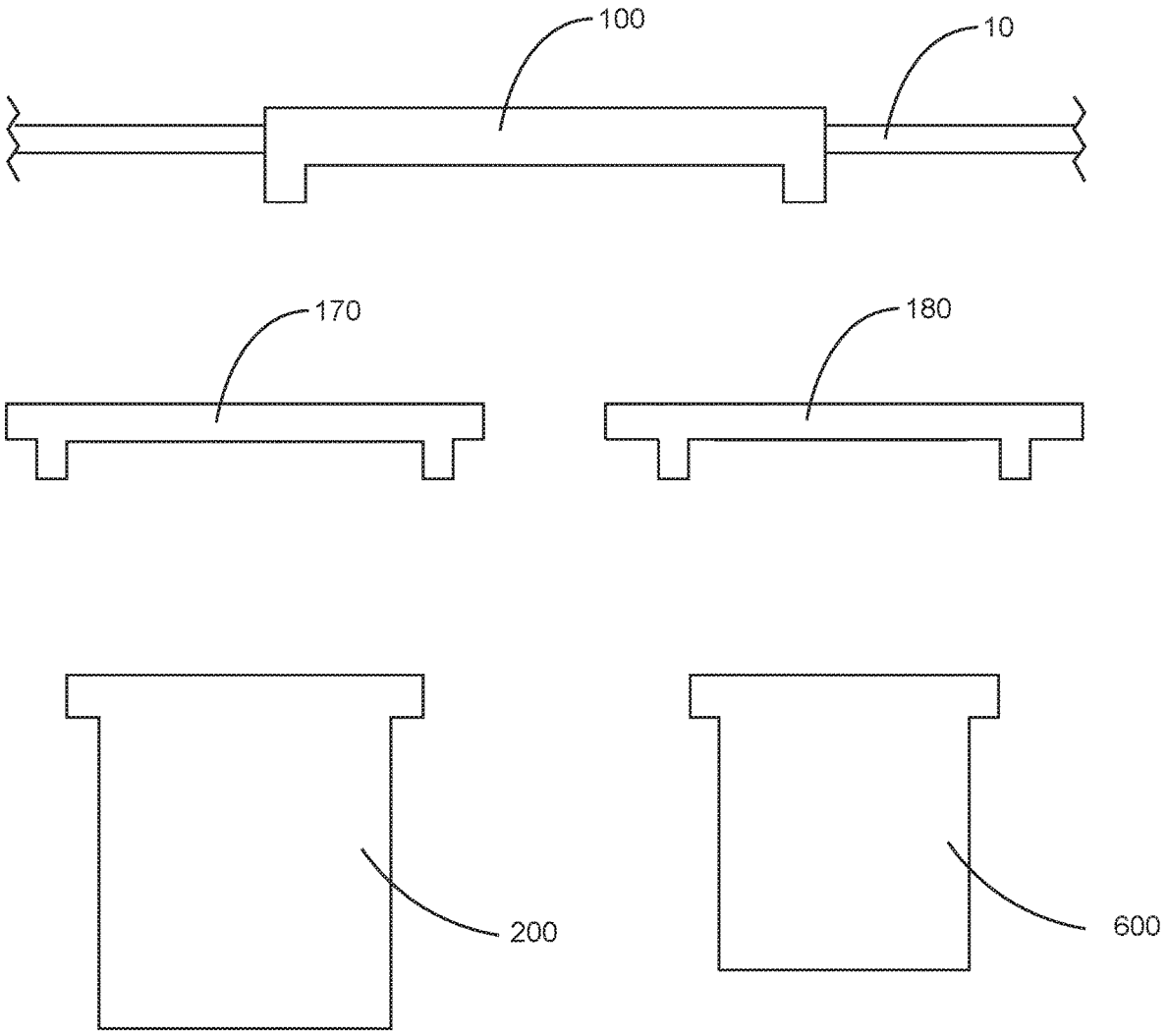
FIG. 12 depicts a schematic view of a transfer port with two interface inserts and two mounting assemblies consistent with embodiments of the technology disclosed herein.

FIG. 12 depicts a schematic view of a transfer port with two interface inserts and two mounting assemblies. The transfer port 100 is configured to (1) interchangeably receive and (2) releasably fasten to a first interface insert 170 and to a second interface insert 180. The first interface insert 170 has a first mounting interface defining a first set of mating features that are configured to form a seal with a first mounting assembly 200. The second interface insert 180 has a second mounting interface defining a second set of mating features, having different geometry than the mating features of the first interface insert 170, that are configured to form a seal with a second mounting assembly configuration 600.

Figure 10:
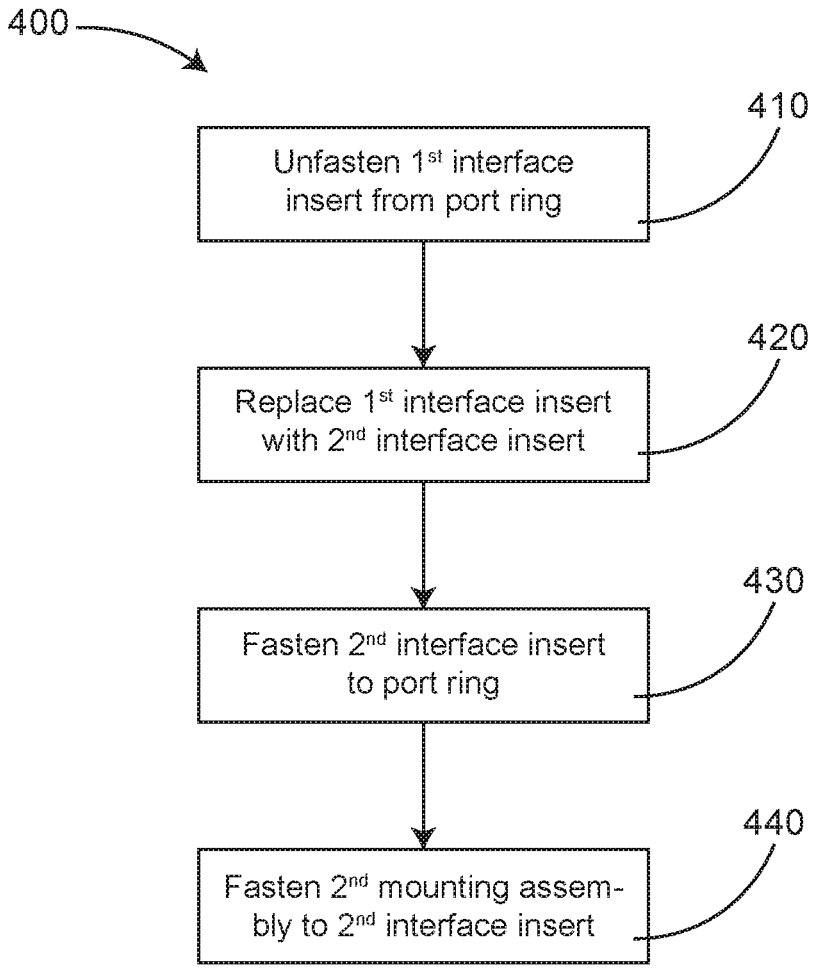
FIG. 10 depicts a method consistent with embodiments of the technology disclosed herein.

To replace the installed interface insert with a replacement interface insert will generally have an approach consistent with FIG. 10, where the first interface insert refers to the previously-installed interface insert and the second interface insert refers to the replacement interface insert. The first interface insert is unfastened from the port ring 410. The first interface insert is replaced with the second interface insert 420. And the second interface insert is fastened to the port ring 430.

The example method of FIG. 10 is now described in view of components depicted in FIG. 4 for clarity, where the element numbers from FIG. 4 are denoted in parentheticals. The first interface insert, which is the first example interface insert (170) depicted in FIG. 4 for purposes of the current discussion, is unfastened from the port ring 410 that is generally installed in a barrier wall. The barrier wall can be a barrier wall of an isolated environment, as described in detail, above. Before the first interface insert is unfastened from the port ring 410, the port door (140) is closed such that the port door (140) obstructs port opening (12) and such that the port door (140) forms a seal with the port ring (160) about the port opening (12). Generally a mounting assembly that is mounted to the mounting interface (120) of the first interface insert (170) will be unmounted from the mounting interface (12) of the first interface insert (170). Unfastening the first interface insert from the port ring 410 will generally relate to the particular fastening mechanism employed between the port ring (160) and the first interface insert (170). In the currently-depicted embodiment, fasteners disposed in the fastener openings 164 165 of the port ring 160 are removed. The fasteners can be loosened or removed from the fastener openings 174, 177 defined by the interface insert 170.

The first interface insert is replaced with the second interface insert 420 by removing the first interface insert (170) from the interface insert receptacle (162) of the port ring (160) and inserting the second interface insert in the interface insert receptacle (162). The port ring 160, particularly the port door (140), maintains isolation between the first side (114) of the barrier wall and the second side (116) of the barrier wall during the replacing of the first interface insert with the second interface insert 420. In some embodiments, a gasketing material (350—see FIG. 8) that is in contact with the sealing surface (168) of the port ring (160) can be replaced before, or in conjunction with, insertion of the second interface insert in the interface insert receptacle. In some embodiments, the gasketing material that is in contact with the sealing surface (168) of the port ring (160) remains in place for insertion of the second interface insert in the interface insert receptacle.

The second interface insert is fastened to the port ring 430 via the particular fastening mechanism that is employed by the system. As such, in embodiments consistent with the figures herein, the second interface insert has fastener openings that are configured to align with fastener openings of the port ring 160 to mutually receive fasteners such as insert screws and/or set screws. The fasteners are inserted in the fastener openings defined by the second interface insert and the port ring to mutually engage the second interface insert and the port ring. Once the second interface insert is fastened to the port ring 430 a mounting assembly having a set of mating features that correspond to the mounting interface of the second interface insert can be mounted to the second interface insert 440. In some embodiments, after fastening the second interface insert to the port ring 430, but before mounting the mounting assembly to the second interface insert, a leak test can be performed on the transfer port to ensure that containment of first side of the barrier wall relative to the second side of the barrier wall has been maintained by the cell flange. The leak test can be a pressure decay leak test, as would be understood by those having ordinary skill in the art.

Components described herein can generally be a constructed with a variety of materials and combinations of materials known in the art. For example, hardened stainless steel can be incorporated in various components of the disclosed interlock assemblies in a multiple embodiments. Further, those having skill in the art will appreciate that throughout this disclosure the term "bayonet," "bayonet connector," and "bayonet receptacle" are used to generally describe the bayonet mating connections herein, which can also encompass ramping or inclined connections or tabs, receiving surfaces, camming surfaces, ears with grooves, and the like, and that such terms are not used to be structurally limiting.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as "arranged", "arranged and configured", "constructed and arranged", "constructed", "manufactured and arranged", and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

This application is intended to cover adaptations or variations of the present subject matter. It is to be understood that the above description is intended to be illustrative, and not restrictive.

What is claimed is:

1. A transfer port system comprising:

a port ring configured for placement in a barrier wall, the port ring defining a port opening and an interface insert receptacle;

a first interface insert configured to be received by the interface insert receptacle, the first interface insert having a first mounting interface defining a first set of mating features that are configured to form a seal with a first set of mounting assemblies;

a second interface insert configured to be received by the interface insert receptacle, the second interface insert having a second mounting interface defining a second set of mating features that are configured to form a seal with a second mounting assembly configuration, wherein the first set of mating features has a first geometry that is different than a second geometry of the second set of mating features; and wherein the interface insert receptacle is configured to (1) interchangeably receive and (2) releasably fasten to each of the first interface insert and the second interface insert.

2. The transfer port system of claim 1, further comprising a gasketing material, wherein the port ring defines a sealing surface concentric to the port opening and the gasketing material is in contact with the sealing surface.

3. The transfer port system of claim 1, the interface insert receptacle comprising at least a portion of an annular surface concentric to the port opening and an inner cylindrical face extending from the annular surface.

4. The transfer port system of claim 3, wherein the inner cylindrical face is substantially perpendicular to the annular surface.

5. The transfer port system of claim 1, the interface insert receptacle comprising a sealing surface concentric to the port opening, wherein the sealing surface is configured to receive a gasketing material to interchangeably form a seal with each of the first interface insert the second interface insert.

6. The transfer port system of claim 1, wherein each of the first set of mating features and the second set of mating features comprises bayonet connectors.

7. The transfer port system of claim 1, wherein the port ring defines fastener openings and the first interface insert and the second interface insert each define corresponding fastener openings that are configured to align with the fastener openings of the port ring.

8. The transfer port system of claim 1, further comprising a port door pivotably coupled to the port ring, wherein the port door is configured to sealably obstruct the port opening.

9. A method of configuring a transfer port comprising:

inserting a first interface insert into an interface insert receptacle defined by a port ring installed in a barrier wall;

fastening the first interface insert to the port ring;

mounting a first mounting assembly to a first mounting interface defined by the first interface insert;

unfastening the first interface insert from the port ring installed in a barrier wall;

replacing the first interface insert in the interface insert receptacle of the port ring with a second interface insert defining a second mounting interface, wherein the second mounting interface has a different geometry than the first mounting interface;

fastening the second interface insert to the port ring; and mounting a second mounting assembly to the second mounting interface of the second interface insert.

10. The method of claim 9, further comprising unmounting the first mounting assembly from the first mounting interface.

11. The method of claim 9, after fastening the second interface insert to the port ring, and before mounting the second mounting assembly to the second mounting interface, performing a leak test on the transfer port.

12. The method of claim 11, wherein the leak test is a pressure decay leak test.

13. The method of claim 9, wherein the port ring isolates a first side of the barrier wall with a second side of the barrier wall and replacing the first interface insert with the second interface insert maintains isolation of the first side of the barrier wall from the second side of the barrier wall.

14. The method of claim 9, wherein fastening the first interface insert to the port ring comprises aligning first interface insert fastener openings defined by the first interface insert with port ring fastener openings defined by the port ring, and inserting fasteners through the insert fastener openings and the port ring fastener openings to mutually engage the port ring and the first interface insert.

15. The method of claim 14, wherein fastening the second interface insert to the port ring comprises aligning second interface insert fastener openings defined by the second interface insert with the port ring fastener openings defined by the port ring, and inserting fasteners through the second interface insert fastener openings and the port ring fastener openings to mutually engage the port ring and the second interface insert.

16. The method of claim 9, wherein the first mounting assembly has different docking features than the second mounting assembly.

17. The method of claim 9, further comprising closing a port door to sealably obstruct a port opening defined by the port ring.

* * * * *